US009267696B2

(12) United States Patent
Gerlach et al.

(10) Patent No.: US 9,267,696 B2
(45) Date of Patent: Feb. 23, 2016

(54) INTEGRATED MEMBRANE DEHUMIDIFICATION SYSTEM

(71) Applicant: Carrier Corporation, Farmington, CT (US)

(72) Inventors: David W. Gerlach, Ellington, CT (US); Sherif Kandil, Ellington, CT (US); Parmesh Verma, Manchester, CT (US); Frederick J. Cogswell, Glastonbury, CT (US); Rajiv Ranjan, Vernon, CT (US); Ahmad M. Mahmoud, Bolton, CT (US); Richard G. Lord, Murfreesboro, TN (US)

(73) Assignee: CARRIER CORPORATION, Farmington, CT (US)

( * ) Notice: Subject to any disclaimer, the term of this patent is extended or adjusted under 35 U.S.C. 154(b) by 169 days.

(21) Appl. No.: 14/191,656

(22) Filed: Feb. 27, 2014

(65) Prior Publication Data

US 2014/0245772 A1 Sep. 4, 2014

Related U.S. Application Data

(60) Provisional application No. 61/772,240, filed on Mar. 4, 2013.

(51) Int. Cl.
*F24F 3/14* (2006.01)

(52) U.S. Cl.
CPC ..... *F24F 3/1411* (2013.01); *F24F 3/1417* (2013.01); *F24F 2003/1435* (2013.01); *F24F 2203/021* (2013.01)

(58) Field of Classification Search
USPC ..... 62/92, 93, 94, 101, 273
See application file for complete search history.

(56) References Cited

U.S. PATENT DOCUMENTS 4,171,620 A * 10/1979 Turner ..... F24F 3/1417 126/647
4,171,624 A 10/1979 Meckler et al.
4,180,985 A 1/1980 Northrup, Jr.
4,222,244 A * 9/1980 Meckler ..... B01D 53/26 62/235.1
4,269,611 A * 5/1981 Anderberg ..... B01D 53/261 96/124
4,300,623 A * 11/1981 Meckler ..... F24F 3/0522 165/210
4,430,864 A 2/1984 Mathiprakasam (Continued)

FOREIGN PATENT DOCUMENTS

WO 0179771 10/2001

OTHER PUBLICATIONS

EP Search Report dated Sep. 10, 2014 corresponding to EP Patent App. 14157538.1.

*Primary Examiner* — Mohammad M Ali
(74) *Attorney, Agent, or Firm* — Cantor Colburn LLP

(57) ABSTRACT

An air temperature and humidity control device is provided including a first heat pump having a compressor, an expansion valve, a condenser, and an evaporator. The first heat pump has a refrigerant circulating there through. A humidity controller includes a first contactor fluidly coupled to the evaporator and condenser. The first contact includes at least one contact module having a porous sidewall that defines an internal space through which a hygroscopic material flows. A first air flow is in communication with the porous sidewall of the first contactor. The device also has a second heat pump including a first polishing coil. The first polishing coil is substantially aligned with and arranged generally downstream from the first contactor relative to the first air flow.

24 Claims, 10 Drawing Sheets

(56) References Cited

U.S. PATENT DOCUMENTS

| | | | | |
|---|---|---|---|---|
| 4,903,503 | A | 2/1990 | Meckler | |
| 4,987,750 | A * | 1/1991 | Meckler | F02G 1/043 62/238.6 |
| 5,460,004 | A | 10/1995 | Tsimerman | |
| 5,471,852 | A * | 12/1995 | Meckler | B01D 53/261 62/271 |
| 5,528,905 | A * | 6/1996 | Scarlatti | B01D 53/229 165/229 |
| 5,953,926 | A * | 9/1999 | Dressler | F24F 3/147 236/44 C |
| 6,216,489 | B1 | 4/2001 | Potnis et al. | |
| 6,247,323 | B1 | 6/2001 | Maeda | |
| 6,405,543 | B2 | 6/2002 | Kopko | |
| 6,497,107 | B2 | 12/2002 | Maisotsenko et al. | |
| RE39,288 | E * | 9/2006 | Assaf | F24F 3/1411 62/271 |
| 7,827,812 | B2 | 11/2010 | Yabu et al. | |
| 7,905,108 | B2 | 3/2011 | Ikegami et al. | |
| 2004/0099140 | A1 * | 5/2004 | Hesse | B01D 53/268 96/8 |
| 2004/0112077 | A1 * | 6/2004 | Forkosh | F24F 3/1417 62/271 |
| 2004/0144528 | A1 * | 7/2004 | Kunimoto | F24D 17/02 165/298 |
| 2005/0109052 | A1 * | 5/2005 | Albers | F24F 3/1417 62/271 |
| 2006/0086120 | A1 * | 4/2006 | Kashirajima | F24F 3/1423 62/271 |
| 2010/0251758 | A1 | 10/2010 | Yabu et al. | |
| 2010/0319370 | A1 | 12/2010 | Kozubal et al. | |
| 2012/0125405 | A1 * | 5/2012 | Vandermeulen | F24F 3/1417 136/248 |
| 2013/0312445 | A1 | 11/2013 | Isetti et al. | |

* cited by examiner

INTEGRATED MEMBRANE DEHUMIDIFICATION SYSTEM

CROSS-REFERENCE TO RELATED APPLICATION

This application claims the benefit of U.S. provisional patent application Ser. No. 61/772,240 filed Mar. 4, 2013, the entire contents of which are incorporated herein by reference.

BACKGROUND OF THE INVENTION

The invention relates generally to an air temperature and humidity control device, and more particularly, to an air temperature and humidity control device integrating more than one heat pump.

Conventional air conditioning systems generally do not perform humidity control functions in an energy efficient manner. When humidity control is desired, air conditioners based on direct expansion (DX) may be operated to condense moisture in the air through supercooling. The drier, supercooled air is then reheated for comfort before entering into a facility to be air conditioned. Significant energy is consumed during the supercooling and reheating of the air, which renders the process inefficient. Moreover, water condensation on the metallic DX coils may cause corrosion problems, which increases the maintenance cost of the air conditioning systems.

In light of the need for more efficient humidity control, air conditioning systems with solid desiccant wheels integrated in temperature control units have been developed. The solid desiccant wheel is loaded with a solid desiccant and is positioned just upstream of the temperature control unit so that cooled air transversely passes over a section of the rotating desiccant wheel, during which the moisture in the air is absorbed by the desiccant. The remaining section of the desiccant wheel is reheated so that the absorbed moisture can be desorbed to regenerate the desiccant. While capable of achieving low humidity outputs, systems based on desiccant wheels are space-consuming and inefficient, as energy is required to regenerate the desiccant. Moreover, because the desiccant wheel is relatively cumbersome and not easy to install or uninstall, the capacity and operation of the systems based on desiccant wheels are generally not intended to accommodate a wide range of operations.

In addition to desiccant wheels, humidity control may be achieved using a system having a heat pump coupled to a liquid desiccant loop. The liquid desiccant, such as lithium chloride for example, is cooled and heated by the heat pump. The desiccant loop includes two contact towers loaded with packing materials or two membrane-type contactors for example. Several sprinklers are provided at the top end of the tower to distribute the liquid desiccant (cooled or heated by the heat pump) onto the packing materials, while air is blown from the bottom end of the contact tower as the liquid desiccant trickles down the packing material. As a result of the direct contact between the desiccant and air, water may be absorbed from the air into the desiccant or desorbed from the desiccant into the air. Simultaneously, the air may be heated or cooled by the liquid desiccant. Because of its integration with a heat pump, the liquid desiccant system discussed above requires less energy for desorbing water from the liquid desiccant, i.e. the regeneration of the liquid desiccant.

However, as the operation of the system requires direct contact between numerous streams of liquid desiccant and air, entrainment of liquid desiccant droplets into the air stream is inherent to spraying direct contact technologies. Such liquid desiccant entrainment (or liquid desiccant carryover) can cause corrosion of ductwork and human health issues. Moreover, similar to the desiccant wheels, the contact towers of the above-discussed system are relatively cumbersome in construction and not easy to modulate to accommodate a wide range of operations.

To address prevalent issues associated with direct contact systems, other systems without direct contact include a contactor having at least one contact module with a porous sidewall that is permeable to water vapor and impermeable to the liquid desiccant employed. The contactor may include at least one contact module with a porous sidewall having exterior and interior sides, wherein the interior side of the sidewall defines an internal space in which the liquid desiccant flows. The blower generates an air flow along the exterior side of the sidewall in order to provide desirable temperature and humidity.

The contactors in these non-direct contact systems commonly include a hydrophobic porous material with limited heat transfer potential, but better mass transfer potential when compared to conventional refrigerant evaporator and condensing technologies. In addition, the performance, size and cost of such materials for the hydrophobic porous contactors needed in these systems places a practical limit on the amount of sensible heat removal that can be achieved economically from the incoming air. Building codes may require that a large fraction of outdoor (ambient) be processed and delivered to the conditioned space within a given temperature and humidity range. The contactor-based temperature and humidity control devices may not be able to process the large fraction of outdoor or process air to desirable conditions in a cost-effective and energy efficient manner.

BRIEF DESCRIPTION OF THE INVENTION

According to one embodiment of the invention, an air temperature and humidity control device is provided including a first heat pump having a compressor, an expansion valve, a condenser, and an evaporator. The first heat pump has a refrigerant circulating there through. A humidity controller includes a first contactor fluidly coupled to the evaporator and condenser of the first heat pump. The first contactor includes at least one contact module having a porous sidewall that defines an internal space through which a hygroscopic material flows. A first air flow is in communication with the porous sidewall of the first contactor such that heat and/or water vapor transfers between the first air flow and the hygroscopic material. The device also has a second heat pump including a first coil. The first coil is arranged generally downstream from the first contactor relative to the first air flow.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
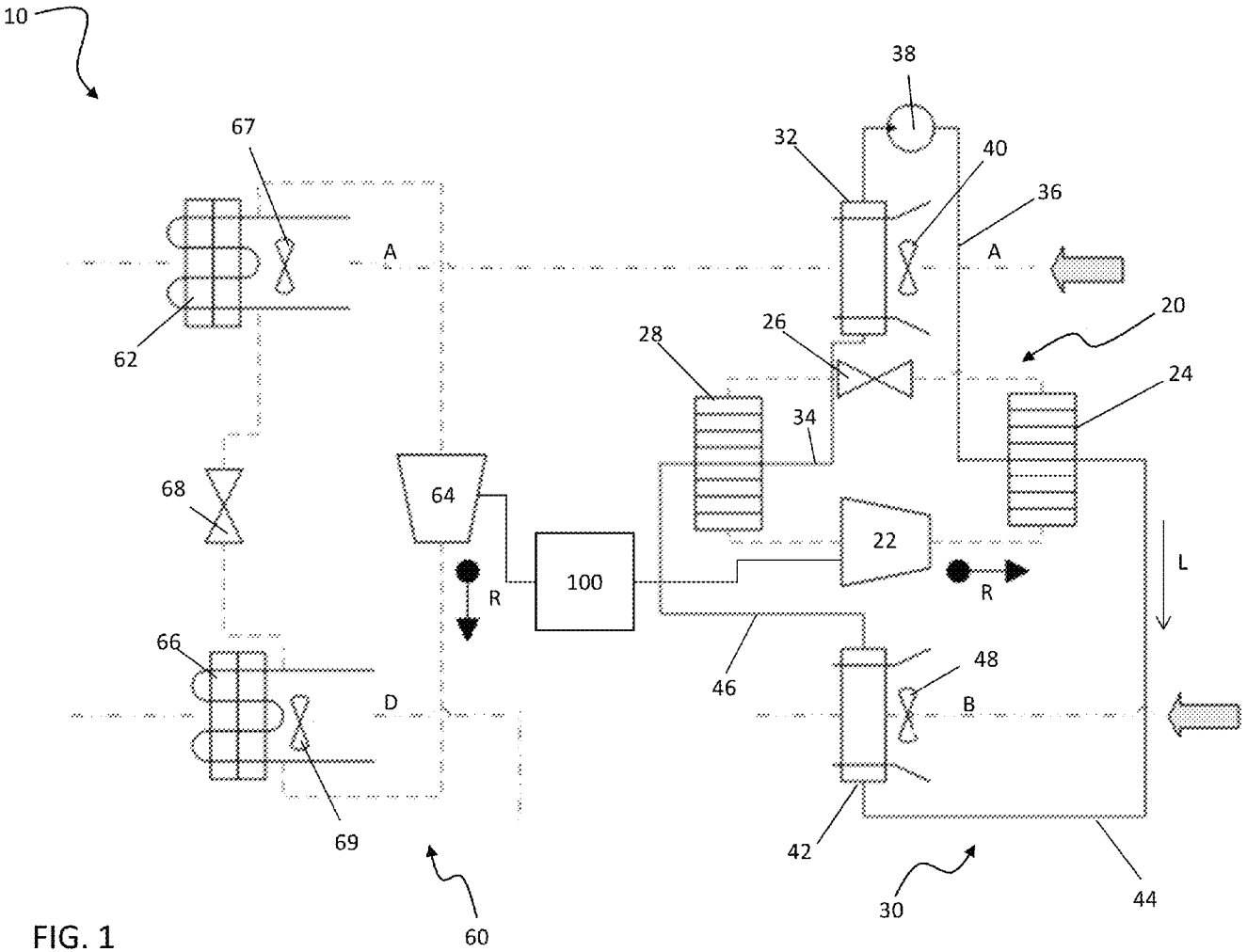
FIG. 1 is a schematic diagram of an air temperature and humidity control device according to an embodiment of the invention.

Referring now to the FIGS. an air temperature and humidity control device 10 is schematically illustrated. The air temperature and humidity control device 10 generally includes a first heat pump 20 and a humidity controller 30. As illustrated, the closed loop first heat pump 20 includes a compressor 22, a condenser 24, an expansion valve 26, and an evaporator 28. In operation, a refrigerant R is circulated through the various components of the heat pump 20 in a known manner so that the refrigerant R is in a compressed state (releasing heat) in the condenser 24 and is in an expanded state (heat absorbing) in the evaporator 28. The refrigerant R may be an environmentally friendly refrigerant, such as R-410 for example; however other suitable refrigerants are within the scope of the invention.

The humidity controller 30 includes a first contactor 32 having hygroscopic material L flowing there through, such as liquid desiccant including an aqueous lithium chloride solution for example. Other suitable hygroscopic materials are within the scope of the invention. The first heat pump 20 and humidity controller 30 may be thermally coupled together so as to allow the hygroscopic material L to be heated in the condenser 24 and cooled in the evaporator 28. In one embodiment, the first contactor 32 is fluidly coupled to the evaporator 28 and the condenser 24 through a first conduit 34 and a second conduit 36, respectively. As illustrated in the FIGS., the hygroscopic material L may be driven by a pump 38 to flow sequentially through the evaporator 28, the first contactor 32, and the condenser 24.

A first blower 40 is configured to generate an air flow A over the adjacent first contactor 32. The air flow A may include air from any of a number of sources including, but not limited to, process air, exhaust air, outdoor air, or a combination thereof for example. The first blower 40 may be an electric fan positioned adjacent to the first contactor 32, or an air outlet or exhaust of a heating ventilation and air conditioning (HVAC) system for example. As the air flow A from the first blower 40 passes over the first contactor 32, heat and/or water transfers between the air flow A and the hygroscopic material L in the first contactor 32 such that after passing over the first contactor 32, the air flow A has a desirable air temperature and/or humidity. In one embodiment, the first contactor 32 serves as an absorber, transferring moisture and/or heat from the air flow A to the hygroscopic material L.

The humidity controller 30 additionally includes a second contactor 42 through which the hygroscopic material L flows. The second contactor 42 may also be thermally coupled to the condenser 24 and the evaporator 28 through a third conduit 44 and a fourth conduit 46, respectively. As illustrated in FIG. 1, the hygroscopic material L may be driven by the fluid pump 38 sequentially through the condenser 24, the second contactor 42, and the evaporator 28. More than one pump 38 may be used to drive the hygroscopic material L though the heat pump 20, such as to provide independent control of the flow of hygroscopic material L through the first contactor 32 and the second contactor 42, or to reduce the pressure within the humidity controller 30 to protect the first contactor 32 and the second contactor 42 from overpressure for example. In addition, to prevent cavitation of the one or more pumps 38, or to allow for concentration shifts and subsequent density variations throughout the humidity controller 30, one or more tanks (not shown) configured to store and supply hygroscopic material L may be included in the humidity controller 30.

A second blower 48 may be provided to generate an air flow B over the second contactor 42. Similar to the air flow A over the first contactor 32, air flow B may include air from any of a number of sources including, but not limited to, process air, exhaust air, outdoor air, or a combination thereof for example. In one embodiment, the second blower 48 may include an electric fan positioned adjacent to the second contactor 42, or alternatively, the electric fan may be substituted by an air outlet of an HVAC system. As the air flow B passes over the second contactor 42, heat and/or water transfers between the air flow B and hygroscopic material L in the second contactor 42 to allow the device to provide a desirable air temperature and/or humidity. In one embodiment, the second contactor 42 serves as a desorber, removing moisture to regenerate the hygroscopic material L.

To facilitate the thermal coupling between the heat pump 20 and humidity controller 30, the evaporator 28 and the condenser 24 may be configured as refrigerant-hygroscopic material heat exchangers. As a non-limiting example, the refrigerant-hygroscopic material heat exchangers may be of a shell-and-tube design, in which a bundle of tubes is disposed within an outer shell. In operation, one fluid flows through the tubes and another fluid flows along the tubes (through the shell) to allow heat transfer between the two fluids. Alternatively, the refrigerant-hygroscopic material heat exchangers may also be of a brazed or welded plate design for compactness and increased heat exchange effectiveness. The refrigerant-hygroscopic material heat exchangers described herein are exemplary and other suitable heat exchangers known to one of ordinary skill in the art are also within the scope of this invention. The humidity controller 30 may include a hygroscopic material-hygroscopic material heat exchanger (not shown) configured to recuperate heat between the flow of hygroscopic material L from the first contactor 32 and the flow of hygroscopic material L from the second contactor 42. In addition, the humidity controller may include one or more bypass flows so that at least a portion of the hygroscopic material L can bypass certain components of the humidity controller 30 to facilitate efficiency and control.

Figure 3:
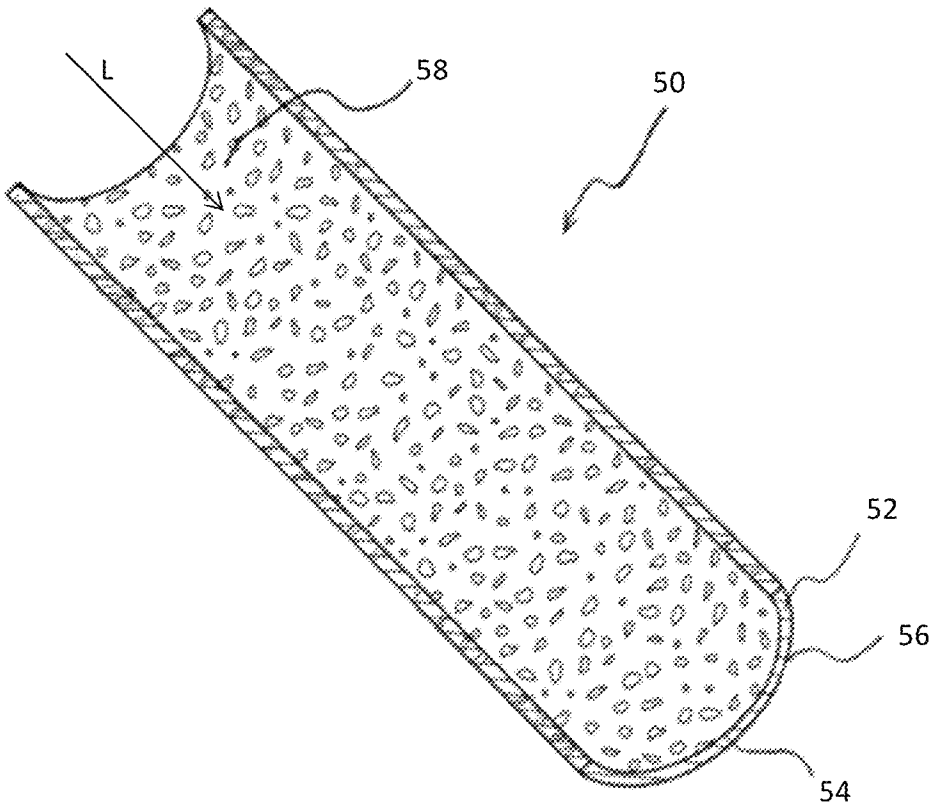
FIG. 3 is a perspective view of a cross-section of a contact module of a contactor according to an embodiment of the invention.

In one non-limiting embodiment, illustrated in FIG. 3, each of the first and second contactors 32, 42 includes at least one contact module 50 having a porous sidewall 52 with an interior side 54 and an exterior side 56. The interior side 54 of the sidewall 52 defines an internal space 58 through which the hygroscopic material L flows. In one embodiment, the contact modules 50 are substantially tubular in shape. However, contactors 32, 42 that use another known humidity absorbing/desorbing device or have other membrane configurations, such as a packed towers, packed beds, planar, spiral configuration for membranes or other separation methods or technologies for example, are within the scope of the invention. Each of the contactors 32, 42 may include at least one end connector (not shown) configured to establish fluid communication between the contact modules 50 and the desiccant conduits 34, 36, 44, 46. Suitable connectors include pipe manifolds, chamber manifolds, or other connectors generally used in fluid transportation. Alternatively, one or both of the contactors 32, 42 may include only one contact module 50, directly connected to the desiccant conduits 34, 36, 44, 46 without any connector.

In order to facilitate humidification and dehumidification, the porous sidewall 52 of the contact module 50 may be permeable to water vapor, and impermeable to the hygroscopic material L so as to form a closed loop. Thus in one embodiment, the porous sidewall 52 is made of a hydrophobic porous material, such as a plastic (polymeric) porous material for example.

Referring again to FIG. 1, the air temperature and humidity control device 10 includes a second heat pump 60 having a first coil 62, such as an evaporator for example, a compressor 64, a second coil 66, such as a condenser for example, and an expansion valve 68. Exemplary embodiments of the second heat pump 60 include, but are not limited to, a residential air conditioning system, a roof top unit, and a chiller having an air handling unit for example. A third blower 67 is arranged generally adjacent the first coil 62 and a fourth blower 69 is arranged adjacent the second coil 66. The blowers 67, 69 are configured to provide a flow of air over the first coil 62 and second coil 66 respectively. In operation, a refrigerant R circulates through the various components of the second heat pump 60 in a known manner so that the refrigerant R is in a compressed state (releasing heat) in the second coil 66 and is in an expanded state (heat absorbing) in the first coil 62. In one embodiment, at least one of the first coil 62 and the second coil 66 is configured as a refrigerant-air heat exchanger. Though both the first heat pump 20 and the second heat pump 60 are illustrated in the FIGS. as simple vapor-compression systems, the heat pumps 20, 60 may include additional components known to a person skilled in the art. Exemplary components configured to enhance the efficiency or capacity of the heat pumps 20, 60 include, but are not limited to, work recovery devices (expanders, etc. . . . ), pressure recovery devices (ejectors, etc. . . . ), suction line heat exchangers, compressors with advanced technologies, and control systems for example.

As illustrated in FIG. 1, a control system 100 may be operably coupled to both the first heat pump 20 and the second heat pump 60. The control system 100 may be coupled to one or more components of each heat pump 20, 60, including, but not limited to the compressors 22, 64, the expansion valves 26, 68, the blowers 40, 48, 67, 69, or the one or more pumps 38 for example. The control system 100 is configured to control at least one of the flow of refrigerant R through both heat pumps 20, 60, the flow of hygroscopic material L through the humidity controller 30, and the flow of air over the contactors 32, 42 and the coils 62, 66 to optimize the performance of the air temperature and humidity control device 10.

The first contactor 32 is arranged generally downstream of the evaporator 28 so that the hygroscopic material L may be cooled in the evaporator 28, such as to a temperature below the ambient temperature for example, before passing through the first contactor 32. The hygroscopic material L cools the at least one contact module 50 of the first contactor 32 as it flows there through. As a result, the cooled contact modules 50 are configured to absorb heat, for example from air flow A adjacent the exterior side 56 of the contact modules 50. The hygroscopic nature may cause the hygroscopic material L to absorb water vapor from the air flow A. Thus, in one embodiment, the at least one contact module 50 of the first contactor 32 decreases both the temperature and the humidity of the air flow A along its exterior side 56.

As illustrated in FIG. 1, the first coil 62 of the second heat pump 60 may be generally aligned with and arranged downstream from the first contactor 32 such that the air flow A is cooled and dehumidified as it passes over the first contactor 32, and the air flow A is further cooled as it passes over the first coil 62. In one non-limiting embodiment, the device 10 may be configured such that the first coil 62 is positioned adjacent to an interior air vent of a facility to be air-conditioned so that the air flow A, after being cooled and dehumidified may be, for example, introduced into the facility for comfort. In another embodiment, illustrated in FIG. 2, a separate air flow C may be configured to pass over the first coil 62 of the second heat pump 60. At least one of air flow A, after having been cooled and dehumidified by the first contactor 32, and air flow C, after having been cooled by the first coil 62, or a mixture thereof, may be provided to the facility to be air-conditioned.

The second contactor 42 is positioned downstream from the condenser 24 such that as the hygroscopic material L passes through the condenser 24, the hygroscopic material L is heated, such as to a temperature above the ambient temperature for example. As the heated hygroscopic material L flows through the at least one contact module 50 of the second contactor 42, the water vapor differential across the porous sidewall 52 causes the hygroscopic material L to release water vapor into the air flow B. The resultant hygroscopic material L is more concentrated than the hygroscopic material L entering the second contactor 42. At the same time, the at least one contact module 50 of the second contactor 42, heated by the hygroscopic material L flowing there through, releases heat to the air flow B along the exterior side 56 of the contact modules 50. Thus, the contact modules 50 of the second contactor 42 may function to increase both the temperature and humidity of the air flow B along its exterior side.

Figure 2:
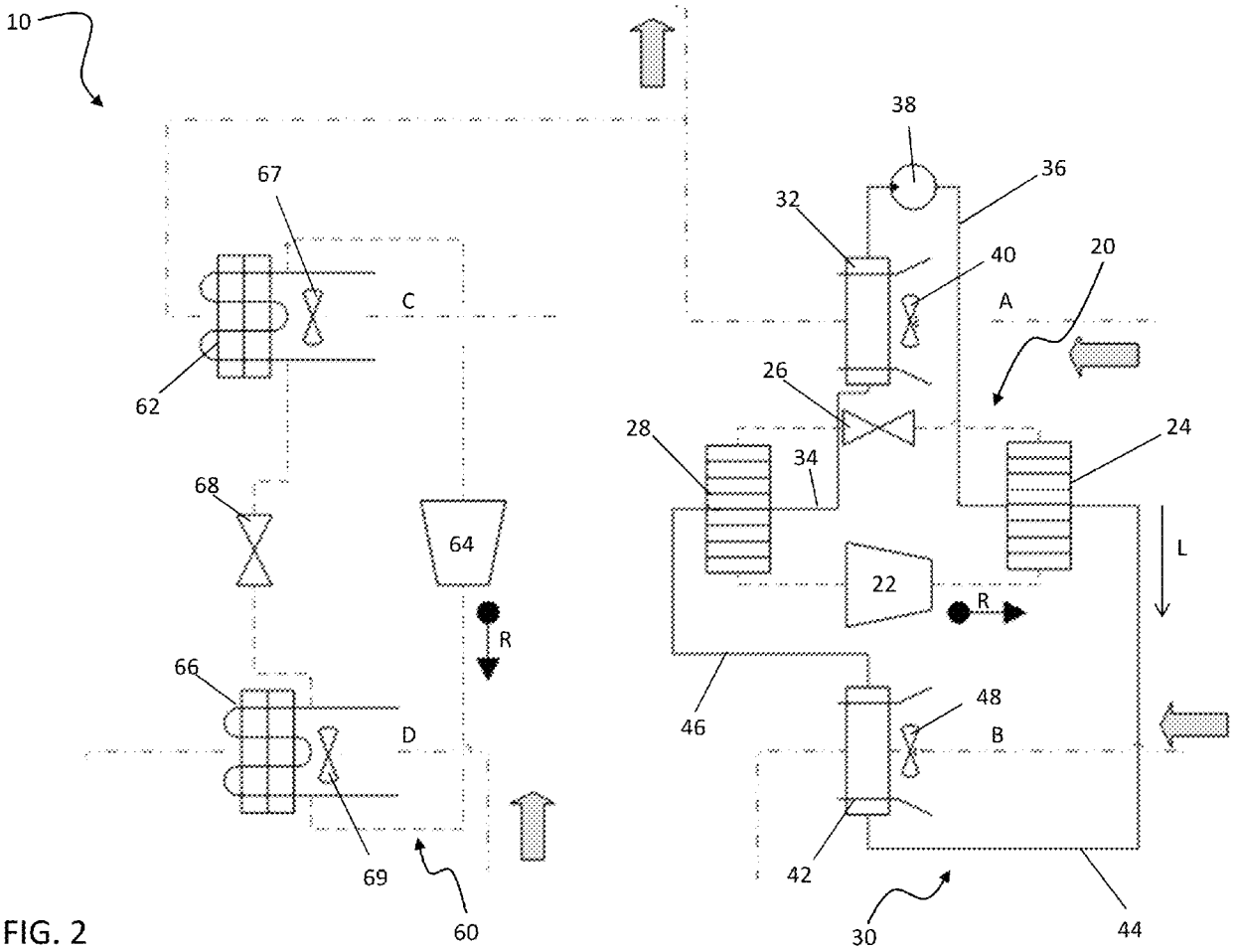
FIG. 2 is a schematic diagram of an air temperature and humidity control device according to another embodiment of the invention

The second coil 66 of the second heat pump 60 may be generally aligned with and arranged downstream from the second contactor 42. As illustrated in FIGS. 1 and 2, a separate air flow D may be configured to flow over the second coil 66, by means of the fourth blower 69, and remove heat from the refrigerant R flowing there through.

Figure 4:
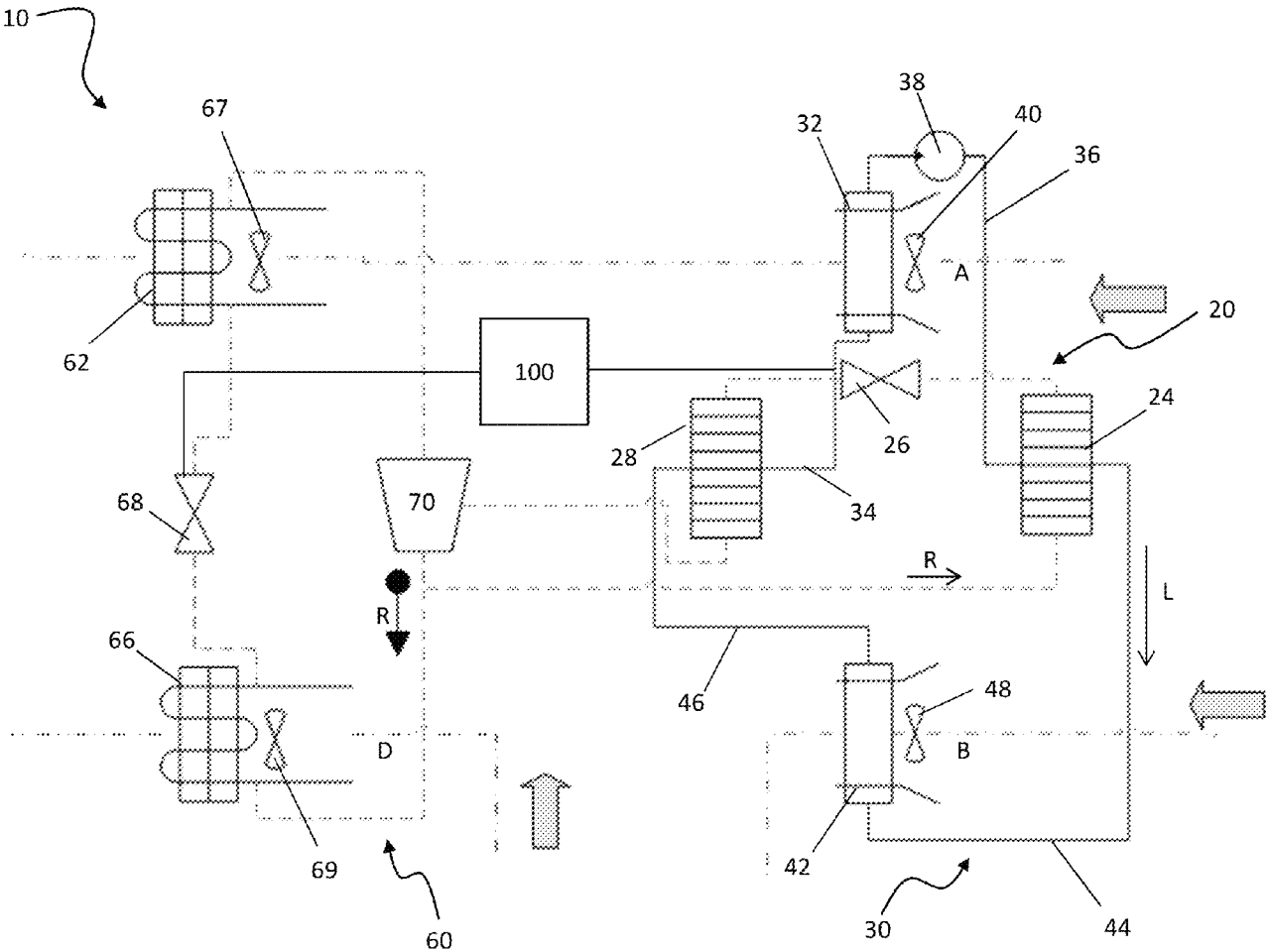
FIG. 4 is a schematic diagram of an air temperature and humidity control device according to another embodiment of the invention.
Figure 5:
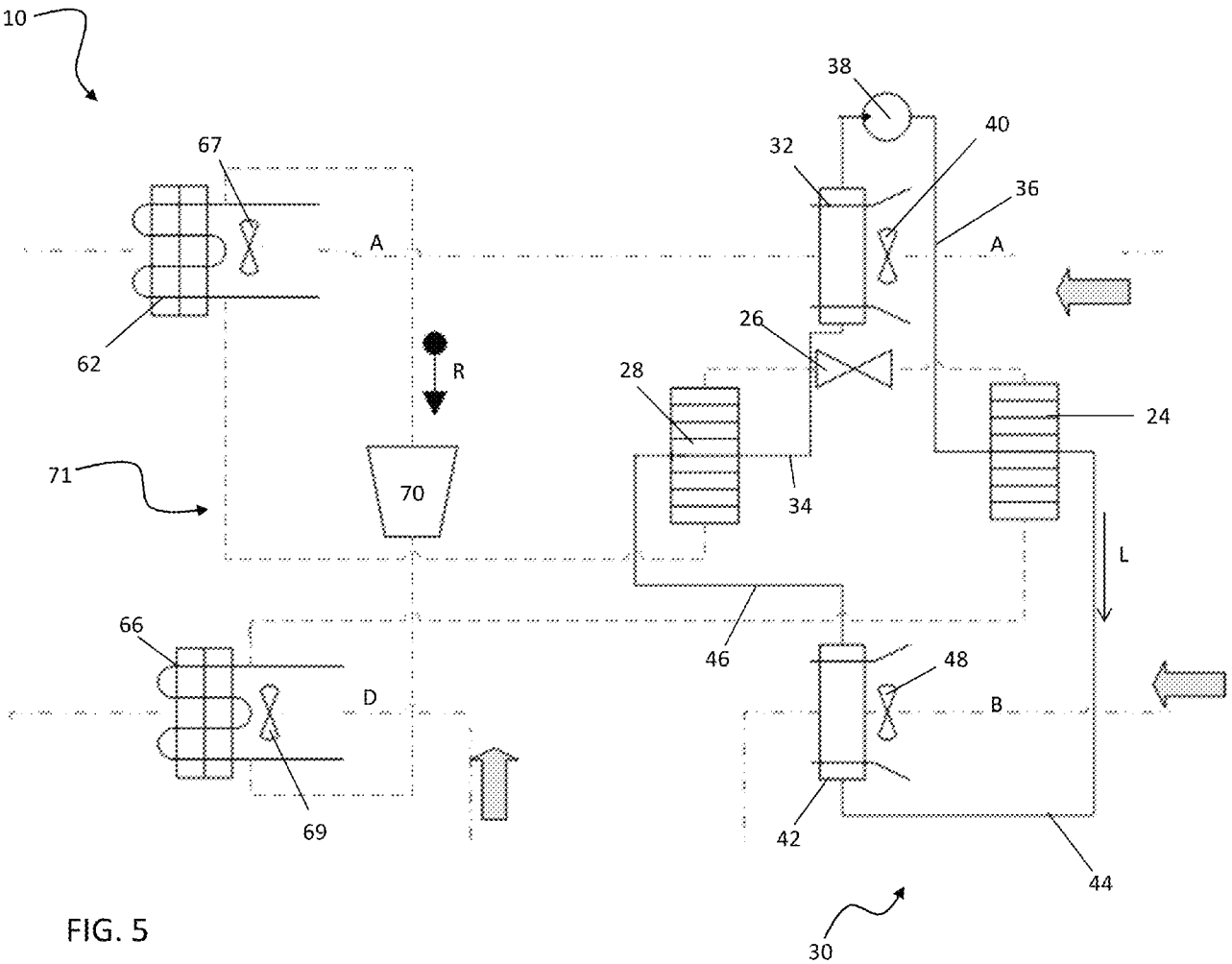
FIG. 5 is a schematic diagram of an air temperature and humidity control device according to another embodiment of the invention.

Referring now to FIG. 4, one or more components of the first heat pump 20 and the second heat pump 60 may be integrated. For example, in the illustrated embodiment, a single compressor 70 may replace both compressors 22, 64. The flow between the two parallel heat pumps 20, 60, may be controlled with the control system 100. In another embodiment, the first heat pump 20 and the second heat pump 60 may be operably coupled to form an integrated refrigerant loop 71 such that the evaporator 28 and the first coil 62 and/or the second coil 66 and the condenser 24 are arranged generally in series (see FIG. 5), or in parallel relative to the refrigerant flow path. By having the evaporator 28 and the first coil 62 arranged in series and the second coil 66 and the condenser 24 similarly arranged in series, the complexity of the device 10 is reduced and the controllability of the device 10 is generally improved.

Figure 6:
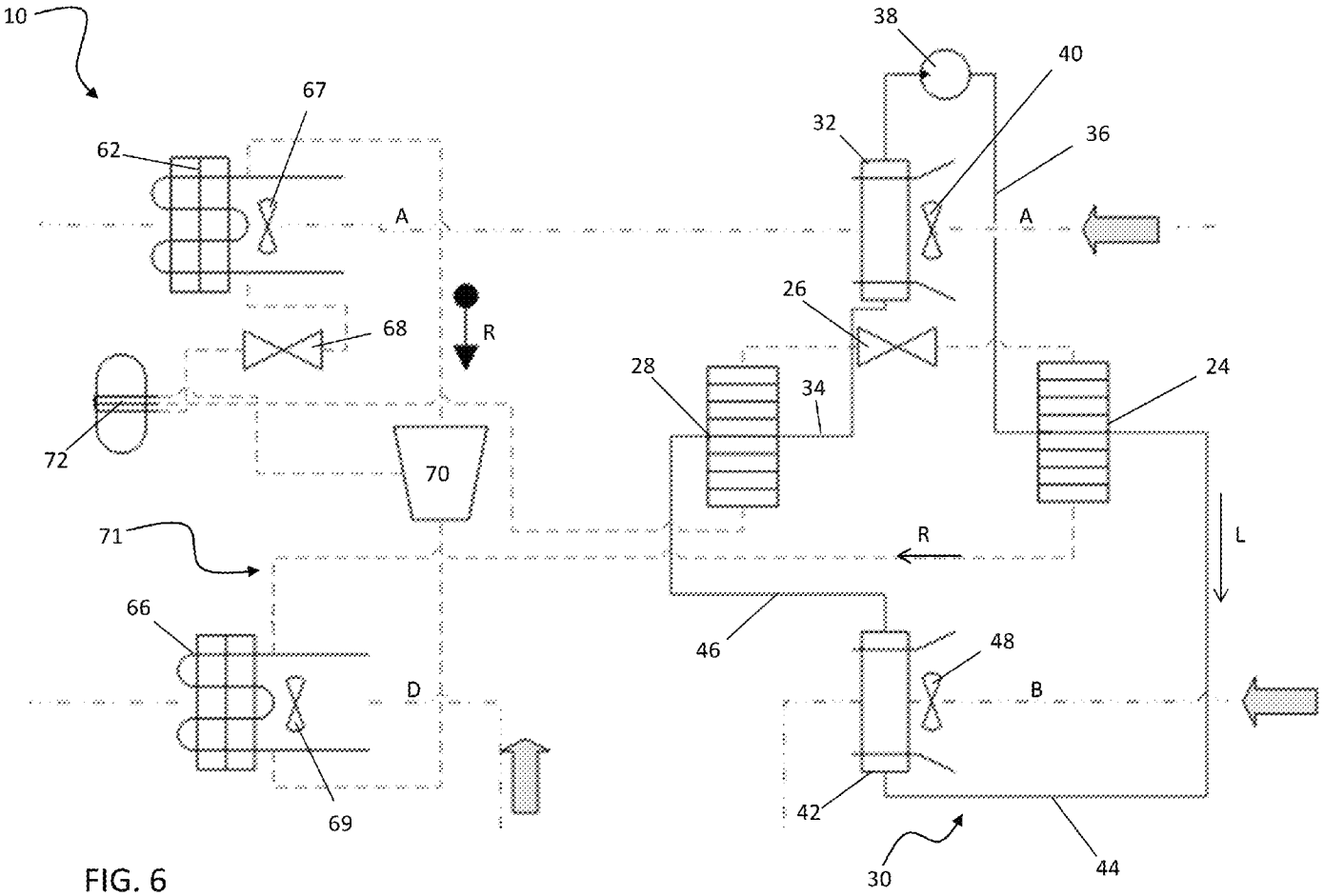
FIG. 6 is a schematic diagram of an air temperature and humidity control device according to another embodiment of the invention.
Figure 7:
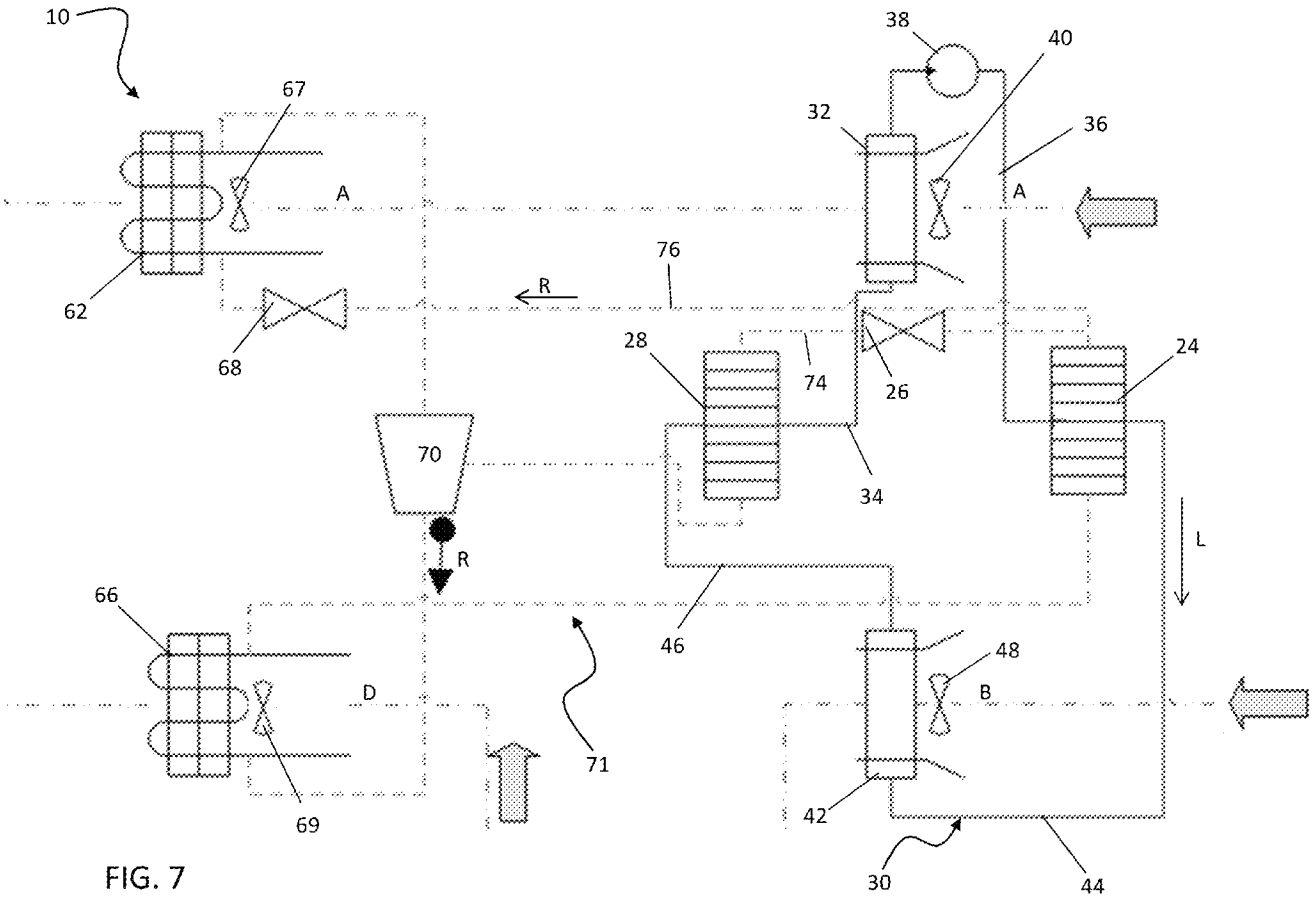
FIG. 7 is a schematic diagram of an air temperature and humidity control device according to another embodiment of the invention.

Referring now to FIG. 6, the efficiency of a device 10 having a portion of an integrally formed first heat pump 20 and a second heat pump 60 arranged generally in series may be improved by positioning a liquid-vapor separator 72 within the integrated refrigerant loop 71, such as between the evaporator 28 and the first coil 62 for example. In one embodiment, the vapor within the separator 72 is provided to the compressor 70, and the liquid from the separator 72 is provided to the expansion valve 68 and then the first coil 62. Since the pressure of the vapor in the separator 72 is higher than the pressure at the first coil 62, the power required by the compressor 70 will be reduced by limiting the amount of flow through the first coil 62. As illustrated in FIG. 7, the second coil 66 and the condenser 24 may be arranged in series, and the evaporator 28 and the first coil 62 may be arranged in parallel. A conduit 74 extending from the condenser 24 to the evaporator 28 includes the first expansion valve 26 and a conduit 76 extending from the condenser 24 to the first coil 62 includes the second expansion valve 68. The flow into each of the conduits 74, 76 is generally controlled by the first expansion valve 26 and the second expansion valve 68 respectively.

Figure 8:
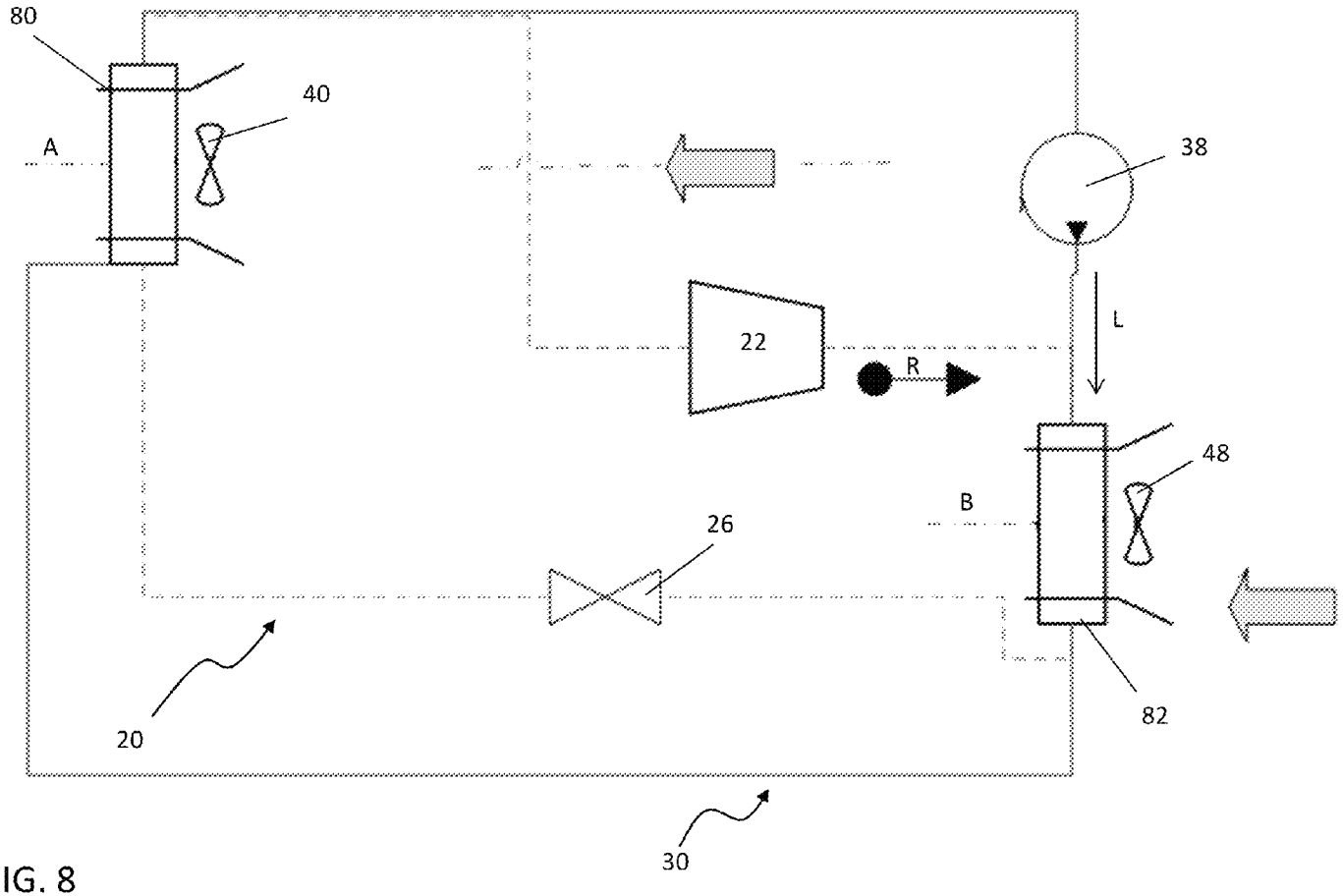
FIG. 8 is a schematic diagram of an air temperature and humidity control device according to another embodiment of the invention.

With reference now to FIG. 8, the complexity of the air temperature and humidity control device 10 may be further reduced by integrating components from the first heat pump 20, and the humidity controller 30. In one embodiment, first contactor 32 and the evaporator 28 are integrated into a first enthalpy device 80, arranged upstream from the compressor 22 and generally adjacent the first blower 40. The first enthalpy device 80 may be configured as a three-way heat exchanger such that heat and/or water vapor transfers between the refrigerant R, the hygroscopic material L, and the air flow A passing over the enthalpy device 80. The condenser 24 and the second contactor 42 may be integrated into a second enthalpy device 82 similarly configured such that heat and/or water vapor transfers between the refrigerant R, the hygroscopic material L, and the air flow B passing over the enthalpy device 82. The second enthalpy device 82 is positioned generally downstream from the compressor 22 adjacent the second blower 48. The first enthalpy device 80 and/or the second enthalpy device 82 may be integrated into any of the air temperature and humidity control devices 10 illustrated in the previous FIGS.

Figure 9:
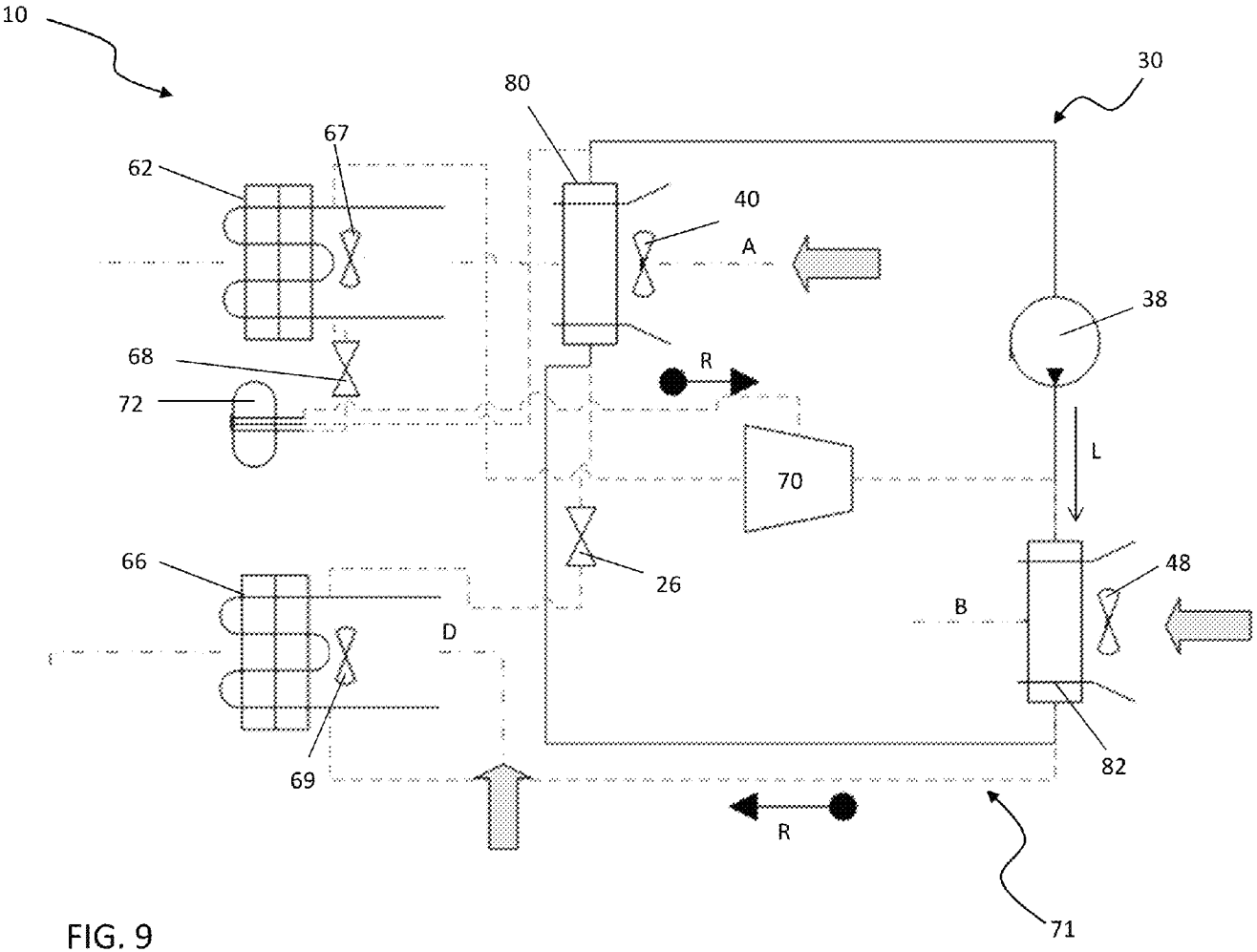
FIG. 9 is a schematic diagram of an air temperature and humidity control device according to another embodiment of the invention.

The air temperature and humidity control device illustrated in FIG. 9 includes both a first enthalpy device 80 and a second enthalpy device 82. In one embodiment, the second coil 66 is arranged downstream from the second enthalpy device 82 with respect to the refrigerant flow R. An air flow D, distinct from the air flow B over the second enthalpy device 82, is configured to remove heat from the refrigerant R flowing through the second coil 66. The first coil 62 is arranged generally downstream from the first enthalpy device 80 with respect to both the refrigerant flow R and the air flow A. Similar to the configuration of the device 10 illustrated in FIG. 6, a liquid-vapor separator 72 may be positioned between the first enthalpy device 80 and the first coil 62 within the integrated refrigeration loop. As previously described, vapor within the separator 72 is provided to the compressor 70, and the liquid from the separator 72 is provided to the expansion valve 68 and then the first coil 62.

Figure 10:
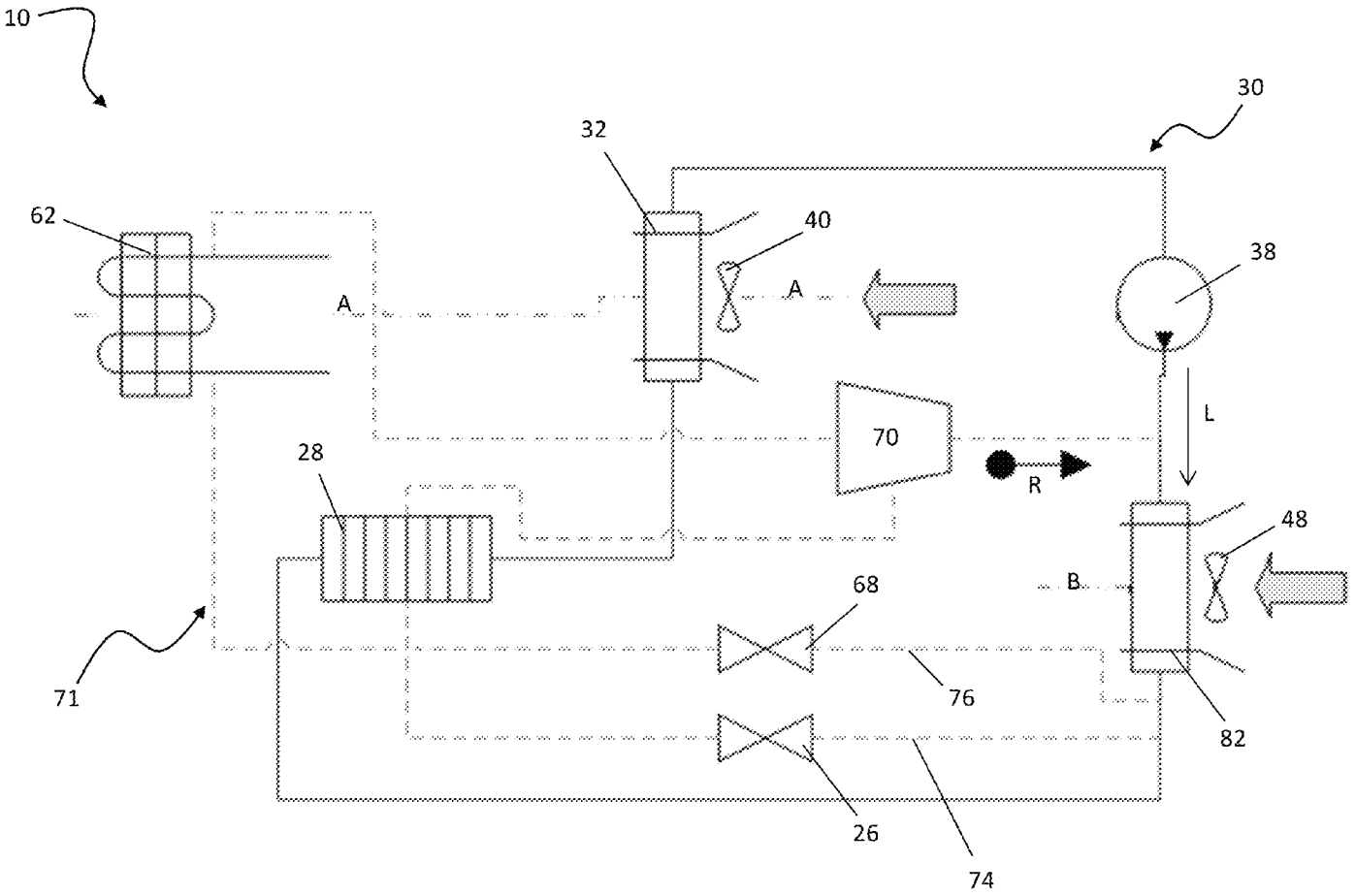
FIG. 10 is a schematic diagram of an air temperature and humidity control device according to another embodiment of the invention.

The air temperature and humidity control device 10 may be further simplified, as illustrated in FIG. 10, by removing one of the coils 64, 68 from the integrated refrigerant loop 71. For example, if the device 10 includes a second enthalpy device 82, the refrigerant R of the integrated refrigeration loop is cooled as it flows through the second enthalpy device 80 in a manner similar to the second coil 66. Alternatively, if the device 10 includes a first enthalpy device 80, the refrigerant R is generally heated within the first enthalpy device 80 in a manner similar to the first coil 62. In the illustrated embodiment, the humidity controller 30 includes a second enthalpy device 82 and a first contactor 32, such that the evaporator 28 and the first coil 62 may be arranged generally in series (see FIG. 5) or in parallel relative to the flow of refrigerant R.

The disclosed air temperature and humidity control device 10 may be arranged in any of a variety of configurations, allowing for tradeoffs between system complexity, cost, physical size, efficiency, and controllability.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An air temperature and humidity control device comprising:

a first heat pump including a compressor, an expansion valve, a condenser and an evaporator, the first heat pump having a refrigerant circulating there through;

a humidity controller having a first contactor fluidly coupled to the evaporator and the condenser, the first contactor including at least one contact module having a porous sidewall that defines an internal space through which a hygroscopic material flows;

a first air flow in communication with the porous sidewall of the first contactor such that heat and/or water vapor transfers between the first air flow and the hygroscopic material; and a second heat pump including a first coil arranged generally downstream from the first contactor relative to the first air flow.

2. The air temperature and humidity control device according to claim 1, wherein the porous sidewall is permeable to water vapor and impermeable to the hygroscopic material.

3. The air temperature and humidity control device according to claim 1, wherein the first contactor is an absorber.

4. The air temperature and humidity control device according to claim 1, wherein at least one of the evaporator and condenser is a refrigerant-hygroscopic material heat exchanger.

5. The air temperature and humidity control device according to claim 1, wherein the first coil is a refrigerant-air heat exchanger.

6. The air temperature and humidity control device according to claim 5, wherein the first coil is an evaporator.

7. The air temperature and humidity control device according to claim 1, wherein the humidity controller further comprises:

a second contactor fluidly coupled to the evaporator and the condenser and including at least one contact module having at least one porous sidewall that defines an internal space through which the hygroscopic material flows; and a second air flow in communication with the porous sidewall of the at least one contact module of the second contactor such that heat and/or water vapor transfers between the second air flow and the hygroscopic material.

8. The air temperature and humidity control device according to claim 7, wherein the second contactor is a desorber.

9. The air temperature and humidity control device according to claim 7, wherein the second heat pump further comprises:

a second coil arranged generally downstream from the second contactor, wherein a third airflow is in communication with the second coil.

10. The air temperature and humidity control device according to claim 9, wherein the second coil is a refrigerant-air heat exchanger.

11. The air temperature and humidity control device according to claim 10, wherein the second coil is a condenser.

12. The air temperature and humidity control device according to claim 9, further comprising a control system operably coupled to the first heat pump and the second heat pump.

13. The air temperature and humidity control device according to claim 9, wherein the humidity controller further comprises a first pump configured to control a flow of hygroscopic material through the first contactor.

14. The air temperature and humidity control device according to claim 13, wherein the humidity controller further comprises a second pump configured to control the flow of hygroscopic material through the second contactor.

15. The air temperature and humidity control device according to claim 9, wherein the humidity controller further comprises a heat exchanger configured to recuperate heat between the hygroscopic material from the first contactor and the hygroscopic material from the second contactor.

16. The air temperature and humidity control device according to claim 9, wherein the first heat pump and the second heat pump are operably coupled.

17. The air temperature and humidity control device according to claim 12, wherein the first heat pump and the second heat pump form a substantially integrated refrigeration loop.

18. The air temperature and humidity control device according to claim 13, wherein at least the evaporator and the first coil are arranged generally in parallel relative to a flow of the refrigerant through the integrated refrigeration loop.

19. The air temperature and humidity control device according to claim 13, wherein at least the evaporator and the first coil are arranged generally in series relative to a flow of the refrigerant through the integrated refrigeration loop.

20. The air temperature and humidity control device according to claim 9, wherein the first contactor and the evaporator of the first heat pump are integrated into a first enthalpy device.

21. The air temperature and humidity control device according to claim 16, wherein the first enthalpy device is a three way heat exchanger configured to transfer heat and/or water vapor between the refrigerant, the hygroscopic material, and the first air flow.

22. The air temperature and humidity control device according to claim 9, wherein the second contactor and the condenser of the first heat pump are integrated into a second enthalpy device.

23. The air temperature and humidity control device according to claim 18, wherein the second enthalpy device is a three way heat exchanger configured to transfer heat and/or water vapor between the refrigerant, the hygroscopic material, and the second air flow.

24. The air temperature and humidity control device according to claim 19, wherein the second coil of the second heat pump is integrated into the second enthalpy device.

* * * * *